United States Patent [19]

Bonner

[11] Patent Number: 4,887,403

[45] Date of Patent: Dec. 19, 1989

[54] INTERNALLY INDEXED BUILDING BLOCK AND METHOD OF CONSTRUCTION

[76] Inventor: David W. Bonner, 2407 Millikin Dr., Arlington, Tex. 76012

[21] Appl. No.: 209,191

[22] Filed: Jun. 17, 1988

[51] Int. Cl.[4] ..... E04C 1/10

[52] U.S. Cl. ..... 52/286; 52/589; 52/593; 52/605; 52/606

[58] Field of Search ..... 52/589, 593, 605, 606, 52/286, 604

[56] References Cited

U.S. PATENT DOCUMENTS

| | | | |
|---|---|---|---|
| 786,884 | 4/1905 | Faulner . | |
| 990,119 | 4/1911 | Diamond . | |
| 1,171,191 | 2/1916 | Gronert et al. | 52/589 |
| 1,412,573 | 4/1922 | Poth et al. | 52/589 |
| 2,271,030 | 4/1939 | Palanti . | |
| 2,668,435 | 2/1954 | Clements | 52/606 |
| 3,888,060 | 6/1975 | Haener | 52/503 |
| 4,107,894 | 4/1978 | Mullins | 52/593 |
| 4,186,540 | 2/1980 | Mullins | 52/593 |
| 4,341,050 | 7/1982 | Long | 52/589 |
| 4,573,301 | 3/1986 | Wilkinson | 52/607 |
| 4,640,071 | 2/1987 | Haener | 52/589 |
| 4,671,039 | 6/1987 | Hunt | 52/593 |

*Primary Examiner*—Carl D. Friedman
*Assistant Examiner*—Caroline D. Dennison
*Attorney, Agent, or Firm*—Charles D. Gunter, Jr.

[57] ABSTRACT

The internally indexed building block of the invention includes a body having opposed side walls and opposed end walls which define an internal cavity therebetween and upper and lower block faces. A web is located within the block internal cavity and divides the internal cavity into a pair of vertical cells. The web terminates at one extent in a pair of vertically extending keys which extend above the block upper face and which span a dish region. The dish region is located within the block internal cavity and is depressed below the block upper face. The dish region forms a mortar cup for receiving mortar whereby an internal bond can be formed between vertical courses of the blocks.

9 Claims, 4 Drawing Sheets

INTERNALLY INDEXED BUILDING BLOCK AND METHOD OF CONSTRUCTION

BACKGROUND OF THE INVENTION

1. Field of the Invention:

The present invention relates to an improved building block and specifically to a building system including such a block.

2. Description of the Prior Art:

General concrete block construction offers durability, longevity, and other unique advantages for construction industries in all countries of the world. Block construction of this type is especially suited for many developing nations where a substantial number of structures are built according to this technique. The existing industry standard concrete block has one or more internal cavities and is planar on all six sides. The blocks are layed up by placing concrete mortar by the trowel method and then shoving and inserting the blocks into the mortar to obtain a bond between mortar and block. Succeeding courses of blocks are layed upon the first course of blocks after mortar is placed along the upper faces and the end walls of the previously layed blocks, resulting in a solid wall mass unit.

The previously described technique of laying concrete blocks produces a wall which is true vertically and horizontally and has the requisite strength. However, a shortage of craftsmen skilled in the technique exists around the world. Because of technical personnel shortages and consequent expense of such construction, concrete block construction has not seen the full utilization which would be expected.

Due to the shortcomings of the prior art construction techniques, various interlocking or mortarless blocks have been proposed. The theory is that interlocking blocks can be layed one upon the other, to lay up a wall without the necessity of skilled tradesmen to align the blocks one upon the other, to apply the mortar, and to position the blocks appropriately.

The mortarless or interlocking blocks known at the present time have various shortcomings. Many such blocks are so complicated in design that very precise molding or other forming techniques are required, raising the cost of the blocks beyond practical limits. Because of the complicated profiles employed, the block internal cavities have generally been of limited size, thereby restricting the passage of wiring or plumbing materials through the block interiors. Other prior art techniques have failed to provide blocks useful both as corner blocks and end blocks, thus requiring several different block designs to complete a single construction project.

The known prior art mortarless blocks are not truly "interlocking", but rather restrict movement in one dimension only. As a result, no design tables or handbooks exist for determining wall strengths for such wall systems. Such systems will not be acceptable for the construction of structures in countries having established building codes or other applications requiring wall strength calculation and certification. Existing locking tab systems are unreliable in their connections, making it difficult to predict their performance under uncontrolled conditions.

The present invention has as its object to provide a wall forming system made up of blocks which can be layed up, with or without mortar, by relatively unskilled workmen, thereby reducing the cost of building erection.

Another object of the invention is to provide a wall forming system which reduces the number of block types required to build a given structure.

Another object of the invention is to provide a wall forming system having an internally keyed indexing system and a mortar receiving internal recess, whereby a wall can be erected which is true horizontally and vertically and which possesses the necessary structural strength to meet existing building codes.

Another object of the invention is to provide an internally bonded block system that resists failure and maintains wall integrity even where cracks occur upon wall movement due to environmental forces.

Additional objects, features, and advantages will be apparent in the written description which follows.

SUMMARY OF THE INVENTION

The internally indexed building block of the invention includes a body having opposed side walls and opposed end walls which define an internal cavity therebetween and upper and lower block faces. The faces are arranged so that the upper and lower faces of one block may receive similar blocks layed in overlying and underlying relationship to form courses of blocks.

A web is located within the block internal cavity and divides the internal cavity into a pair of vertical cells. The web terminates at one extent in a pair of vertically extending keys which extend above the block upper face and which span a dish region. The dish region is located within the block internal cavity and is depressed below the block upper face. The dish is adapted to receive mortar to internally bond one block in the course to another.

The web forms two key receiving openings on the block lower surface. Each vertically extending key on the block upper surface is adapted to be received within one of the key receiving openings of another block which is arranged in overlying relationship in a course of blocks. Preferably, the block opposed end walls and opposed side walls are provided with oppositely arranged male and female surfaces which mate in complimentary fashion with the end and side walls of other blocks aligned side-by-side, side-to-end, and end-to-end in an integrated wall system.

DESCRIPTION OF THE PREFERRED EMBODIMENT

Figure 1:
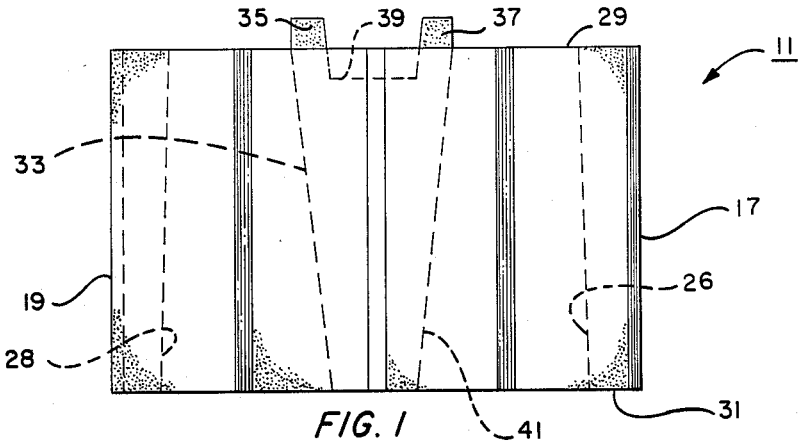
FIG. 1 is a side view of a full length building block of the invention showing the internal surfaces thereof in dotted lines.
Figure 2:
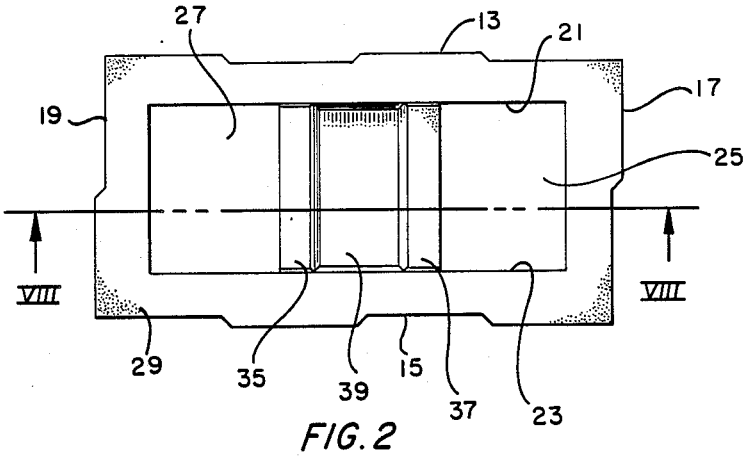
FIG. 2 is a top, plan view of the block of FIG. 1.
Figure 3:
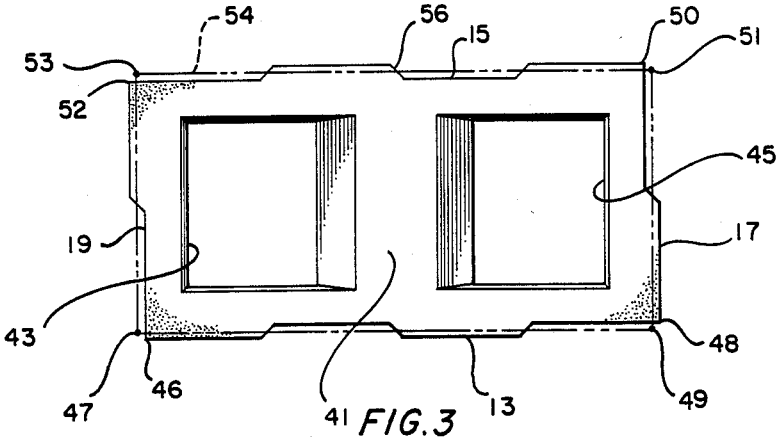
FIG. 3 is bottom, plan view of the block of FIG. 1.
Figure 4:
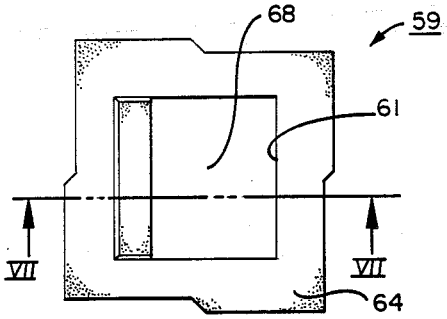
FIG. 4 is a top, plan view of a half-length block made according to the teachings of the present invention.
Figure 5:
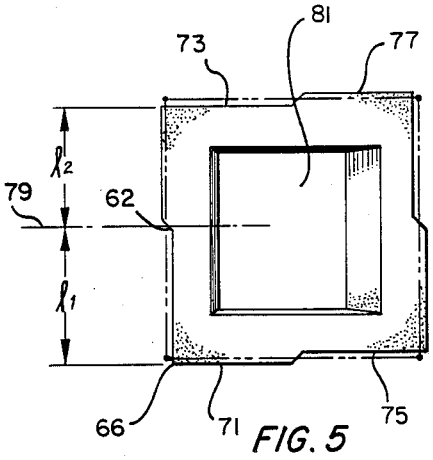
FIG. 5 is a bottom view of the half-length block of FIG. 4.
Figure 7:
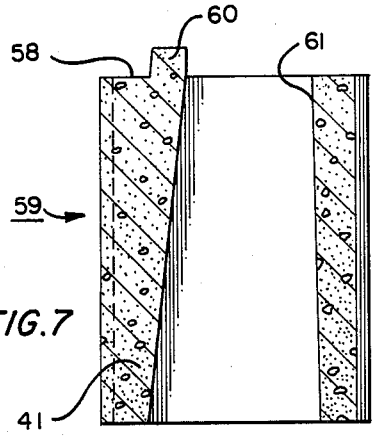
FIG. 7 is sectional view taken along line VII—VII in FIG. 4.

FIGS. 1–3 show an internally indexed building block of the invention designated generally as 11. The block 11 includes a body which is substantially rectangular in plan view and has two longer side walls 13, 15 and two opposed shorter end walls 17, 19. The ratio of the block length to width is 2:1. The two longer side walls 13, 15 are spaced apart from parallel interior walls 21, 23 by an internal cavity and are connected together by the two shorter end walls 17, 19. A solid web 33 divides the internal cavity of the block so that the side and end walls together define internal passages or cells 25, 27. As shown in FIGS. 2 and 3, the block side and end walls also define upper and lower block faces 29, 31. The block faces 29, 31 are arranged so that the upper and lower faces of one block may receive similar blocks layed in overlying and underlying relationship to form courses of the blocks.

The solid web 33 terminates, at its upper extent, in a pair of vertically extending keys 35, 37 which extend above the block upper face 29 and which a span a dish region 39. The dish region 39 is generally rectangular in shape and is located within the block internal cavity and depressed below the block upper face 29.

The solid web 33 includes a wedge-shaped extent 41 which terminates flush with the block lower face 31 (FIGS. 1 and 3) but which terminates below the block upper face 29 to form the dish region 39. The vertically extending keys 35, 37 are arranged parallel to the block end faces 17, 19 and extend from within the internal cavity of the block, on either side of the dish region, to a point above the block upper face 29. Each vertically extending key 35, 37 forms a rectangular tab which extends above the block upper face 29 and, together with the dish 39, forms a saddle region with respect to the block upper face 29.

As shown in FIG. 1, the web 33 is located equidistant between the opposed end walls 17, 19 of the block, thereby forming the two oppositely arranged internal cells 25, 27 within the block internal cavity. As viewed from the side in FIG. 1, the web tapers inwardly from the block upper face 29 in the direction of the block lower face 31, whereby the key receiving openings (43, 45 in FIG. 3) formed on the block lower face 31 are larger than the corresponding cells openings 25, 27 formed on the block upper face 29 (See FIG. 2). As a result, the width of a bottom cell 45 opening is equal to the sum of a top cell 25 opening plus the width of a vertically extending tab 37. The bottom cell opening 45 is square so that the key of the block upper surface will always fit in an end-to-end, side-to-side, and side-to-end configuration. The interior walls 26, 28 of the block also taper slightly inward from the block lower face 31 in the direction of the block upper face 29, i.e., oppositely from the web.

As best shown in FIG. 3, the block lower face 31 has opposing corners 46, 48, 50, 52 which are outside the confines of an imaginary rectangular module which can be said to define a "normal plane" for the sidewalls of the blocks making up block system of the invention. The imaginary rectangular module is defined by corner points 47, 49 51, 53 in FIG. 3. The imaginary module is only completed when the blocks 11 are aligned end-to-end and side-to-side in a wall system.

Figure 9:
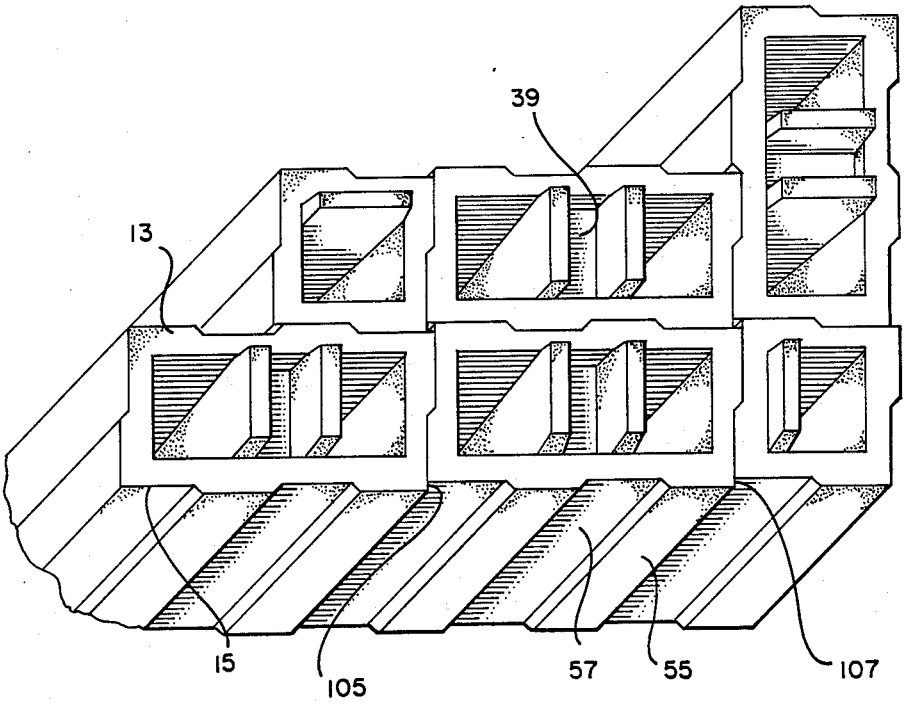
FIG. 9 illustrates how the blocks of the invention fit together in use.

As shown in FIG. 9, the block opposed side walls 13, 15 are provided with oppositely arranged male and female surfaces which mate in complimentary fashion with the side walls of other blocks aligned side-by-side and side-to-end in the integrated wall system. Preferably, each male surface comprises a flute 55 which projects outwardly from the "normal plane" of the wall, as defined with respect to FIG. 3. Each flute projects outwardly an equal distance from the normal plane. Each female surface comprises a land 57 which runs parallel to the flute and which is recessed from the normal plane of the wall. That is, the imaginary line 54 represents the normal plane and bisects each angled portion 56 of the sidewall. Each flute presents a flat outer surface and each land presents a flat inner surface for the block 11. The end walls 17, 19 are similarly provided with complementary male and female surfaces. The flutes and lands 55, 57 provide resistance to movement in one dimension but do not interlock the blocks in the wall system.

Figure 6:
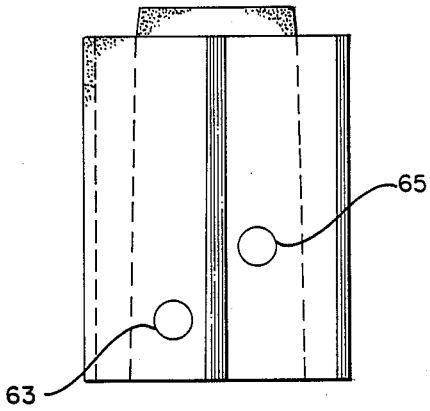
FIG. 6 is an end view of the block of FIG. 4 showing the internal surfaces in dotted lines and showing reinforcement receiving holes provided in the block lower portions.
Figure 8:
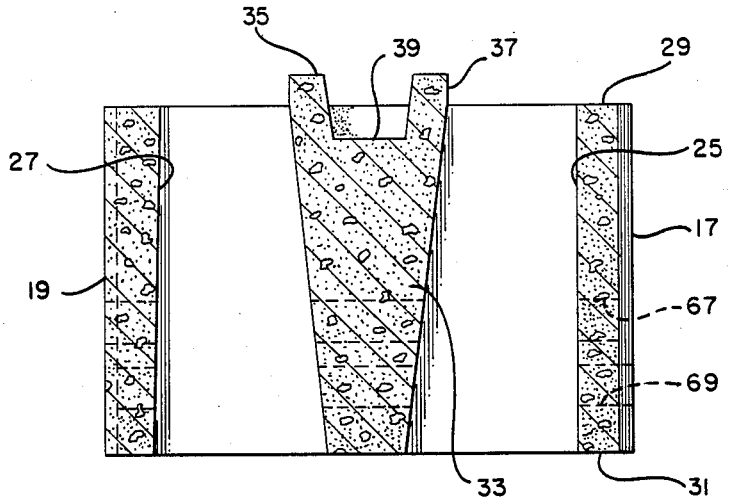
FIG. 8 is a sectional view taken along line VIII—VIII in FIG. 2.

FIGS. 4–7 show a half-length block 59 for use with the full-length block 11. Unlike the full-length block, the half-length block 59 has only one cell opening 61 and half of the wedge-shaped web 41. The upper face 58 also lacks the dish depression adjacent the tab 60. The half-block perimeter profile radiates (FIG. 4 and 5) outwardly in pinwheel fashion about the center axis 68. The half-length block 59 can be provided with transverse openings 63, 65 in the bottom one-third of the block, as shown in FIG. 6. FIG. 8 shows another version of the full-length block of FIG. 1 in which similar transverse openings 67, 69 are provided in the bottom one-third of the block. The openings 63, 65, 67, 69 are adapted to receive a reinforcing rod for joining several blocks in a line, as when forming a lintel or bond beam.

As with the full-length block, the half-length block (FIG. 5) has opposed side and end walls with oppositely arranged lands and flutes. For instance, flute 71 is arranged opposite land 73 and flute 77 is arranged opposite land 75. However, the two half sections or lengths on each side and end face are not symmetrical about a center line 79 drawn to bisect the cell opening 81. Thus, although the center line 79 passes through the mid-point of the angled portion 62, length $L_1$ is greater than the length $L_2$. Length $L_1$ is not the reverse mirror image of length $L_2$.

Figure 10:
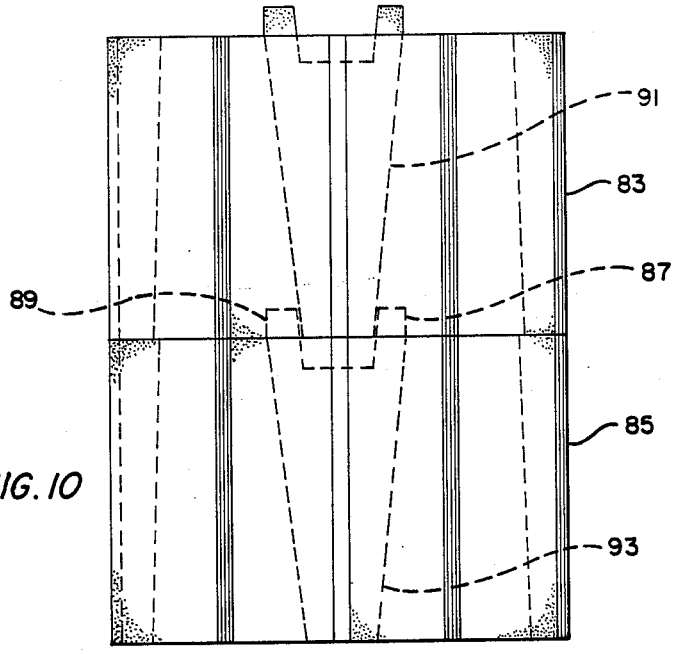
FIG. 10 illustrates schematically how the full-length blocks of the invention stack bond together in vertical fashion.

FIG. 10 shows two full-length blocks 83, 85 arranged in a vertical stack bond. The vertically extending keys 87, 89 of the lower block 85 are received within the two key receiving openings on the block lower surface of block 83. The wedge-shaped portion 91 transmits force into the aligned saddle region and web 93 of the lower block 85. As a result, the weight of block 83 is distributed uniformly about the lower block 85.

Figure 11:
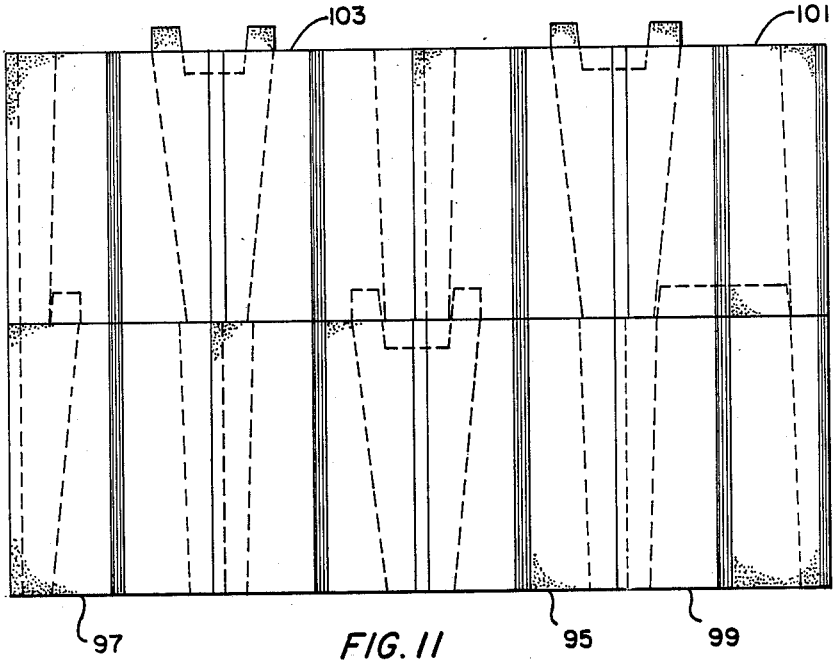
FIG. 11 illustrates schematically how the blocks stack together in end-to-end and side-to-end in running bond fashion.

FIG. 11 shows a wall system using blocks of the invention. A full length block 95 is aligned end-to-end with half-length block 97 on one side and side-to-end with full-length block 99. Full-length blocks 101, 103 are arranged in a running bond above the bottom course of blocks made up by blocks 95, 97, 99. Because the block corners are outside the confines of the imaginary rectangular module, a completed wall system leaves a series of external seams 105, 107 (FIG. 9) which can be weather stripped with caulk or mortar. The alternating pattern of flutes and lands 55, 57 presents a lath tooth for plaster.

The method of constructing a wall using the blocks of the invention will now be described. As shown in FIG. 9, a first course blocks can be arranged at a common elevation by mating the opposing wall surfaces of the blocks in end-to-end, side-to-end, and side-to-side fashion. Mortar is then preferably placed within the dish regions 39 before stacking an additional course of blocks upon the first course. As shown in FIG. 10, the keys 87, 89 and dish depression provide a mortar cup for bonding the lower block 85 to the upper block 83. The keys 87, 89 also internally index the blocks for proper alignment so that the blocks are true both horizontally and vertically.

Figure 12:
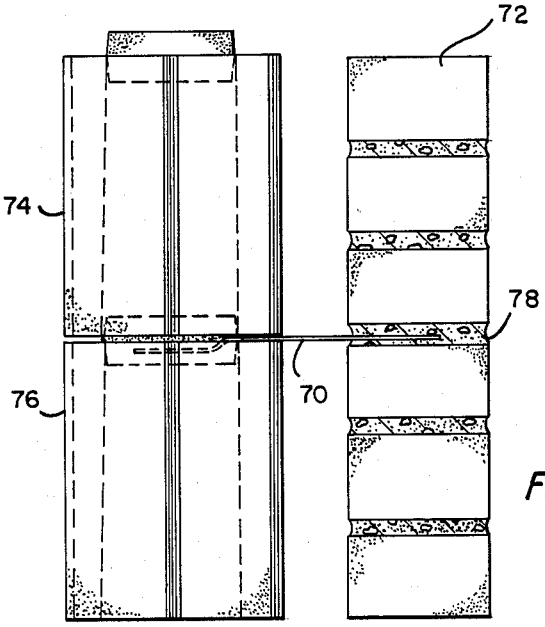
FIG. 12 illustrates a stack bond between two blocks of the invention with the bonded saddle regions receiving a metal strap of the type used for supporting a brick veneer.

The dish 39 (FIG. 9) and mating wedge (91 in FIG. 10) also provide a nailer location for nails or screws and provide a positive locking location for receiving a metal strap of the type used to secure an external brick veneer. FIG. 12 shows a metal strap 70 joining a brick veneer 72 to stack bonded blocks 74, 76. The strap 70 is held by the mortar joint 78 of the brick veneer and by the saddle lock of blocks 74, 76.

The block system of the invention has several advantages over existing systems. in addition to those previously mentioned. The center mass of the web portions provide larger concrete massing for large load bearing capacity and stronger walls. The cell openings 25, 27 are larger than those presently provided in existing blocks for receiving plumbing and utility or reinforcement means. Because of the internal dish for receiving a mortar bond, strength criteria can be calculated allowing the wall system to meet existing building codes and specifications. Chipping or damage to the vertically extending keys 35, 37 will not prohibit use of the damaged block since the block can be erected with a mortar bond. Exterior locking is not required and the block can be provided with a plain exterior or simple contour. The block can be provided in any four inch vertical increment or fraction thereof by six inches width or fraction thereof. The complimentary profile allows the blocks in an integrated system to fit closely together and stop weather. The walls can be sealed with available sealants including pitch, caulks, mud, cement, mortar, etc. Vertical reinforcement can be easily applied through the vertical cell openings and mortar can be used to fill the cells to provide additional vertical walls strength. Because of its simple design, the block can be easily molded.

Since the mortar bond is internal to the block, the block can be provided as a full increment module high dimension. That is, the standard block is 7⅝" high to allow space for a mortar joint. The present block will be 8" high or fraction thereof with no mortar joint. The block will course with conventional masonry, brick veneer or masonry building products. Bond beams and lintels can be formed by drilling transverse holes through the bottom third of the block. Only two block types are required, full and half length, to complete an entire wall system.

In areas where building codes are not governing, the block system can be erected without the use of mortar. However, with mortar application, the block system of the invention will meet all existing building codes and engineering applications requiring wall strength calculations. The application of mortar involves the single step of applying mortar to the dish and forming the stack bond. Existing systems require filling the cells with mortar and running vertical reinforcement to produce a bonded wall.

While the invention has been shown in only two of its forms, it is not thus limited but is susceptible to various changes and modifications without departing from the spirit thereof.

I claim:

1. An internally indexed building block, comprising:

a body having opposed side walls and opposed end walls which define an internal cavity therebetween and upper and lower block faces, the faces being arranged so that the upper and lower faces of one block may receive similar blocks layed in overlying and underlying relationship to form courses of blocks;

a web located within the block internal cavity and dividing the internal cavity into a pair of vertical cells, the web terminating at one extent in a pair of vertically extending keys which extend above the block upper face and which span a dish region, the dish region being located within the block internal cavity and being depressed below the block upper face; and wherein the web forms two key receiving openings on the block lower surface, and wherein each vertically extending key on the block upper surface is adapted to be received within one of the key receiving openings of another block which is arranged in overlying relationship in a course of blocks, the vertically extending keys being centrally located within the internal cavity to thereby form a protected interior fitting which is spaced-apart from the block end walls when the keys are received within the key openings of another block arranged in overlying relationship in a course of blocks.

2. An internally indexed building block, comprising:

a body having opposed side walls and opposed end walls which define an internal cavity therebetween and upper and lower block faces, the faces being arranged so that the upper and lower faces of one block may receive similar blocks layed in overlying and underlying relationship to form courses of blocks;

a web located within the block internal cavity and dividing the internal cavity into a pair of vertical cells, the web terminating at one extent in a pair of vertically extending keys which extend above the block upper face and which span a dish region, the dish region being located within the block internal cavity and being depressed below the block upper face; and wherein the web forms two key receiving openings on the block lower surface, and wherein each vertically extending key on the block upper surface is adapted to be received within one of the key receiving openings of another block which is arranged in overlying relationship in a course of blocks, the vertically extending keys being centrally located within the internal cavity to thereby form a protected interior fitting which is spaced-apart from the block end walls when the keys are received within the key openings of another block arranged in overlying relationship in a course of blocks, and wherein each vertically extending key forms a rectangular tab which extends above the block upper face generally parallel to the block end walls and terminating at the block opposed side walls.

3. The building block of claim 2, wherein the key receiving openings are arranged to receive a vertically extending key of another block arranged in the same vertical plane as well as the vertically extending key of another block arranged in a ninety degree plane.

4. The building block of claim 3, wherein the web portion includes a solid wedge-shaped extent which terminates flush with the block lower face but which terminates below the block upper face to form the dish region, the vertically extending keys extending from within the internal cavity, on either side of the dish region, to a point above the block upper face, whereby the dish region and vertically extending keys together form a saddle region with respect to the block upper face, and wherein each vertically extending key has an exterior which is generally parallel to the block end faces and an interior which slopes inwardly from top to bottom whereby the saddle region is tapered from top to bottom.

5. The building block of claim 4, wherein the web is located equidistant between the opposed end walls of the block, thereby forming two oppositely arranged cells of equal size within the block internal cavity.

6. The building block of claim 7, wherein the wedge-shaped extent of the web is tapered inwardly from the block upper face in the direction of the block lower face, whereby the key receiving openings formed on the block lower face are larger than the corresponding cell openings formed on the block upper face.

7. An internally indexed building block for use in an integrated wall system, comprising:

a body having opposed side walls and opposed end walls which define an internal cavity therebetween and upper and lower block faces, the faces being arranged so that the upper and lower faces of one block may receive similar blocks laid in overlying and underlying relationship to form courses of blocks;

a web located within the block internal cavity and dividing the internal cavity into a pair of vertical cells, the web terminating at one extent in a pair of vertically extending keys which extend above the block upper face and which span a dish region, the dish region being located within the block internal cavity and being depressed below the block upper face, the block upper face being a continuous planar surface which lies in a parallel plane to that of the block lower face;

wherein the web forms two key receiving openings on the block lower surface, and wherein each vertically extending key on the block upper surface is adapted to be received within one of the key openings of another block which is arranged in overlying relationship in a course of blocks, the vertically extending keys being centrally located within the internal cavity to thereby form a protected interior fitting which is spaced-apart from the block end walls when the keys are received within the key openings of another block arranged in overlying relationship in a course of blocks; and wherein the block opposed end walls are provided with oppositely arranged male and female surfaces which mate in complimentary fashion with the end walls of other blocks which are aligned end-to-end in the integrated wall system.

8. The building block of claim 7, wherein the block opposed side walls are provided with oppositely arranged male and female surfaces which mate in complimentary fashion with the side walls of other blocks aligned side-by-side and side-to-end in the integrated wall system.

9. The building block of claim 8, wherein each male surface comprises a flute projecting from the normal plane of the wall and wherein each female surface comprises a land which runs parallel to the flute and which is recessed from the normal plane of the wall, each flute presenting a flat outer surface and each land presenting a flat inner surface for the block wall.

* * * * *